US008870555B2

(12) United States Patent
Feller et al.

(10) Patent No.: US 8,870,555 B2
(45) Date of Patent: Oct. 28, 2014

(54) SCREW COMPRESSOR

(75) Inventors: Klaus Feller, Herrenberg (DE); Roni Loerch, Straubenhardt (DE); Tihomir Mikulic, Holzgerlingen (DE); Julian Pfaffl, Stuttgart (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 13/605,488

(22) Filed: Sep. 6, 2012

(65) Prior Publication Data

US 2013/0058822 A1 Mar. 7, 2013

Related U.S. Application Data

(63) Continuation of application No. PCT/EP2011/053222, filed on Mar. 3, 2011.

(30) Foreign Application Priority Data

Mar. 8, 2010 (DE) ..... 10 2010 002 649

(51) Int. Cl.

| | |
|---|---|
| ***F04C 18/16*** | (2006.01) |
| ***F04C 29/00*** | (2006.01) |
| ***F04C 29/04*** | (2006.01) |
| ***F04C 29/02*** | (2006.01) |

(52) U.S. Cl.

CPC ..... *F04C 18/16* (2013.01); *F04C 29/0014* (2013.01); *F04C 29/042* (2013.01); *F04C 29/028* (2013.01); *F04C 29/021* (2013.01)

USPC ..... 418/84; 418/98

(58) Field of Classification Search

USPC ..... 418/84, 98; 417/228

See application file for complete search history.

(56) References Cited

U.S. PATENT DOCUMENTS

| | | | |
|---|---|---|---|
| 4,173,440 | A | 11/1979 | Libis |
| 4,289,461 | A | 9/1981 | Van Oorschot et al. |
| 2005/0089432 | A1 | 4/2005 | Truyens et al. |

FOREIGN PATENT DOCUMENTS

| | | | |
|---|---|---|---|
| BE | 1017320 | A3 | 6/2008 |
| EP | 0 000 131 | A1 | 1/1979 |
| EP | 0 007 295 | A2 | 1/1980 |
| EP | 1 087 185 | A1 | 3/2001 |
| EP | 1 128 067 | A1 | 8/2001 |
| GB | 2 111 662 | A | 7/1983 |
| WO | WO 2009/121151 | A1 | 10/2009 |

*Primary Examiner* — Charles Freay

*Assistant Examiner* — Patrick Hamo

(74) *Attorney, Agent, or Firm* — Reinhart Boerner Van Deuren P.C.

(57) ABSTRACT

In order to improve a screw compressor comprising a housing, at least one screw rotor arranged in a compressor housing of the housing, a lubricant sump which is arranged on the high pressure side and in which lubricant collects, and a lubricant supply device which supplies lubricant from the lubricant sump to the at least one screw rotor, in such a manner that the amount of circulating lubricant can be kept as small as possible for adequate lubrication, it is suggested that the lubricant supply device comprise a first lubricant supply system and a second lubricant supply system, that the first lubricant supply system supply lubricant to the at least one screw rotor during operation of the screw compressor and that the second lubricant supply system additionally supply lubricant to the at least one screw rotor and thereby be activatable and deactivatable.

17 Claims, 3 Drawing Sheets

SCREW COMPRESSOR

CROSS-REFERENCE TO RELATED PATENT APPLICATIONS

This application is a continuation of international application number PCT/EP2011/053222 filed on Mar. 3, 2011.

This patent application claims the benefit of International application No. PCT/EP2011/053222 of Mar. 3, 2011 and German application No. 10 2010 002 649.2 of Mar. 8, 2010, the teachings and disclosure of which are hereby incorporated in their entirety by reference thereto.

BACKGROUND OF THE INVENTION

The invention relates to a screw compressor comprising a housing, at least one screw rotor arranged in a compressor housing of the housing, a lubricant sump, which is arranged on the high pressure side and in which lubricant collects, and a lubricant supply device which supplies lubricant from the lubricant sump to the at least one screw rotor.

Screw compressors of this type are known from the state of the art, with which a lubricant supply device is provided which is constantly operated and is to be configured such that the lubricant circulated in it ensures an adequate discharge of heat from the housing of the screw compressor even at maximum load and so a large amount of lubricant is constantly circulating.

For this purpose, a lubricant cooling device, which cools the circulating lubricant, is, for example, provided.

The object underlying the invention is to improve a screw compressor of the type described above in such a manner that the amount of circulating lubricant can be kept as small as possible for adequate lubrication.

SUMMARY OF THE INVENTION

This object is accomplished in accordance with the invention, in a screw compressor of the type described at the outset, in that the lubricant supply device comprises a first lubricant supply system and a second lubricant supply system, that the first lubricant supply system supplies lubricant to the at least one screw rotor during operation of the screw compressor and that the second lubricant supply system additionally supplies lubricant to the at least one screw rotor and can thereby be activated and deactivated.

The advantage of the solution according to the invention is to be seen in the fact that the activatable and deactivatable second lubricant supply system offers the possibility of adapting the amount of circulating lubricant to the operational state of the screw compressor and, therefore, of adapting the amount of lubricant to the operational state present each time in as optimum a manner as possible.

In this respect, it is particularly favorable when the screw compressor can be operated in a normal load operation and in a high load operation and when the second lubricant supply system is deactivated during normal load operation and activated during high load operation.

The advantage of this solution is to be seen in the fact that it is possible, as a result, to increase the amount of circulating lubricant during high load operation by means of the second lubricant supply system and, therefore, to provide for sufficient cooling of the screw compressor during high load operation but to reduce the amount of circulating lubricant for normal load operation in relation to high load operation.

In principle, it would be conceivable to define the normal load operation and the high load operation dependent on the operational specifications for the screw compressor.

One particularly favorable solution provides, however, for a compressor control which recognizes whether normal load operation or high load operation is present.

Such a differentiation between normal load operation and high load operation can be brought about in the most varied of ways.

For example, it is provided for normal load operation to be present below a predeterminable threshold value for the load on the screw compressor and high load operation to be present above the threshold value for the load so that the compressor control, in particular, is able to differentiate between normal load operation and high load operation on the basis of the predeterminable threshold value.

Such a threshold value for the load on the screw compressor could, for example, be the input power of a drive for the screw compressor.

Alternatively or in addition, one advantageous solution provides for normal load operation to be carried out when a temperature measured on the high pressure side is below a predeterminable temperature threshold and high pressure operation when the measured temperature is above the temperature threshold.

With respect to the amount of lubricant flowing through the first lubricant supply system and the determination thereof, no further details have so far been given.

It would, for example, be conceivable to provide a lubricant conveyor pump, by means of which the amount of lubricant which flows through the first lubricant supply system can be determined, wherein the amount of lubricant can vary according to the speed of the screw rotor.

One particularly advantageous embodiment of a screw compressor according to the invention does, however, provide for the amount of lubricant flowing through the first lubricant supply system to be determined by a difference in pressure between a pressure in the lubricant sump and a pressure at a supply opening to the at least one screw rotor.

Such a solution has the great advantage that, on the one hand, a lubricant conveyor pump can be omitted and, on the other hand, the amount of lubricant which is required for lubrication can be determined in a simple manner.

In addition, it is also advantageously provided in conjunction with the second lubricant supply system for the amount of lubricant flowing through the second lubricant supply system to be determined by a difference in pressure between a pressure in the lubricant sump and a pressure at a supply opening to the at least one screw rotor.

As a result, the amount of lubricant through the second lubricant supply system may also be determined in a simple manner.

It is also possible, in particular, to determine the amount of lubricant flowing through the second lubricant supply system in that the supply opening is at a different pressure to the supply opening of the first lubricant supply system.

The pressure at the respective supply openings results primarily from the location of the respective screw rotor, at which the supply opening is provided for supplying lubricant to it, i.e. from the position of the respective supply opening between the high pressure side and the suction side of the screw rotor.

In conjunction with the preceding description of the individual embodiments, no further details have been given as to whether a targeted cooling of the amounts of lubricant should take place.

One advantageous solution provides for the amount of lubricant conveyed by the first lubricant supply system to be coolable by a lubricant cooling device so that heat can be discharged from the amount of lubricant circulating in the first lubricant supply system in a defined manner as a result of this lubricant cooling device.

A simple solution provides, in this respect, for the lubricant cooling device to constantly cool the amount of lubricant conveyed by the first lubricant supply system.

Alternatively thereto, it is, however, also conceivable for the lubricant cooling device to cool the amount of lubricant conveyed by the first lubricant supply system during high load operation of the compressor.

A further variation is for the lubricant cooling device, where applicable, to cool the amount of lubricant flowing through the first lubricant supply system during normal load operation in a controlled manner.

A further, advantageous solution provides for the amount of lubricant conveyed by the second lubricant supply system to be coolable by a lubricant cooling device.

This lubricant cooling device can be identical to the cooling device for the amount of lubricant of the first lubricant supply system.

It is, however, also conceivable to provide a separate lubricant cooling device for the amount of lubricant of the second lubricant supply system.

One particularly favorable solution provides for the amounts of lubricant of the first and second lubricant supply systems to be coolable with the lubricant cooling device.

Within the scope of the solution according to the invention, it has proven to be particularly advantageous when a lubricant cooling device is provided which can be operated in an active state or in an inactive state and/or in states therebetween.

For example, such a lubricant cooling device is designed such that it has a lubricant cooler which can be operated by way of a controllable bypass line in all possible states from the active up to the inactive state.

No further details have been given concerning the design of the screw compressor according to the invention.

One particularly advantageous solution, for example, provides for a lubricant outlet for the supply of lubricant to the lubricant supply systems as well as lubricant inlets for the supply of lubricant to the first lubricant supply system and to the second lubricant supply system to be provided on the housing.

As a result, the lubricant supply systems can be activated separately in a simple manner and, where applicable, the activation controlled without the housing needing to be entered for this purpose.

In this respect, it is particularly favorable when the lubricant outlet and the lubricant inlets open into a distributor unit which can be mounted on the housing.

As a result, the distribution of the lubricant to the lubricant supply systems as well as the activation, in particular, of the second lubricant supply system can be realized in a simple manner by a distributor unit provided externally to the housing.

Furthermore, the distributor unit may preferably be constructed such that it has connections for an external lubricant cooler so that the connection of the external lubricant cooler is also brought about via the distributor unit.

Furthermore, the distributor unit may preferably be designed such that lubricant fed back from the lubricant cooler can be supplied to the first lubricant supply system and the second lubricant supply system in the distributor unit.

Furthermore, it is preferably provided for a control valve to be provided in the distributor unit prior to the lubricant inlet of the second lubricant supply system.

Moreover, it is preferably provided for a bypass line located between the connections for the external lubricant cooler to be provided in the distributor unit with a control valve which offers the possibility of activating or deactivating the lubricant cooler or also setting intermediate states.

Additional features and advantages of the invention are the subject matter of the following description as well as the drawings illustrating several embodiments.

DETAILED DESCRIPTION OF THE INVENTION

Figure 1:
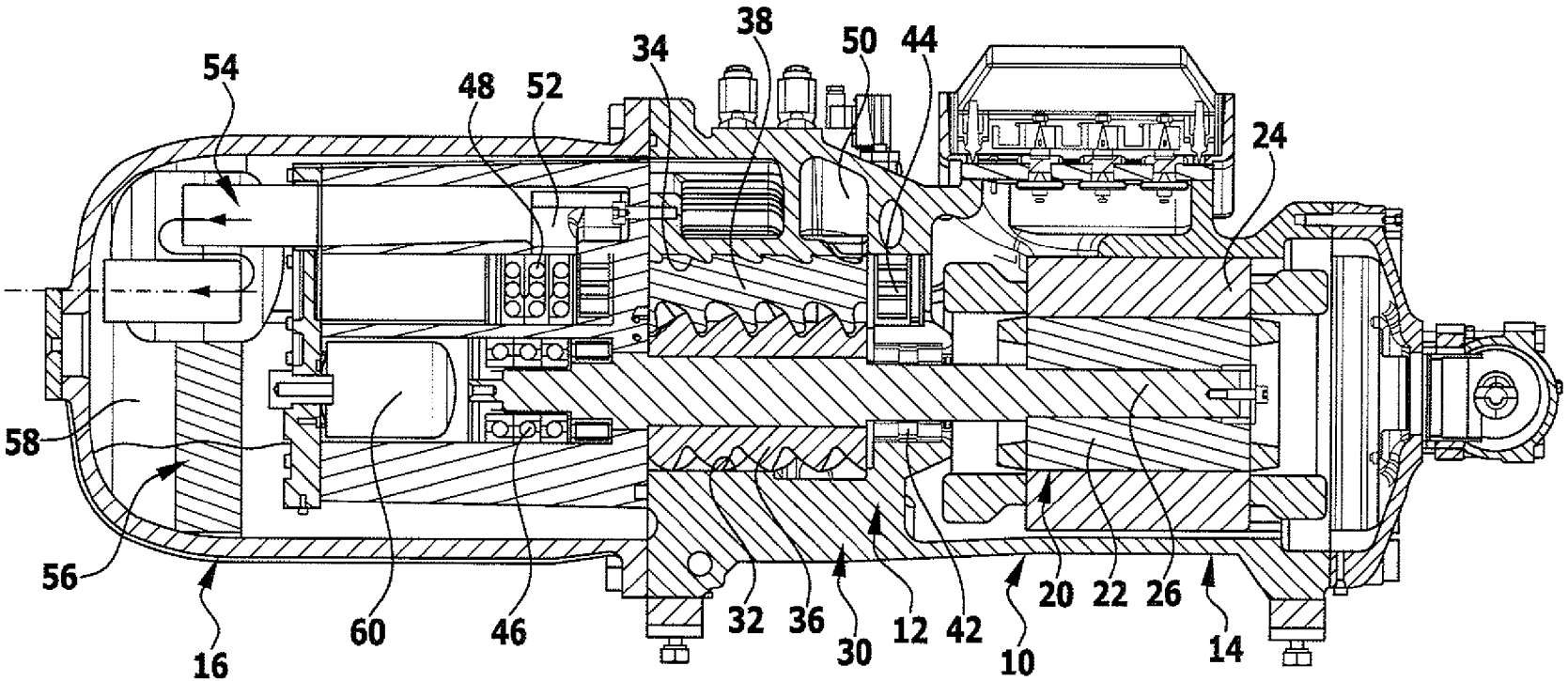
FIG. 1 shows a longitudinal section through a first embodiment of a screw compressor according to the invention.

One embodiment of a screw compressor according to the invention, illustrated in FIG. 1, comprises a housing which is designated as a whole as 10 and is constructed from a central section 12, an end section 14 on the motor side and an end section 16 on the pressure side.

A drive motor designated as a whole as 20 is arranged in the end section 14 on the motor side and this is designed, for example, as an electric motor which comprises a stator 22 which is held in the end section 14 and surrounds a rotor 24 which is, for its part, arranged on a drive shaft 26.

A compressor housing designated as a whole as 30 is formed in the central section 12 of the outer housing 10 and has rotor bores 32 and 34, in which screw rotors 36 and 38 are arranged which are rotatable about axes parallel to one another.

For example, the screw rotor 36 is seated on the drive shaft 26 passing through it.

Bearings 42 and 44 on the low pressure side as well as bearings 46 and 48 on the high pressure side are provided for mounting the screw rotors 36 and 38 and they are arranged in corresponding bearing receptacles of the housing 10.

The screw rotors 36 and 38 compress medium which is supplied via a suction chamber 50, flows out via a high pressure outlet 52 and, in this respect, passes through, for example, a sound absorber 54 as well as a lubricant separator 56 which has the effect that lubricant is separated from the compressed medium and collects in the end section 16 on the pressure side in the form of a lubricant sump 58.

Alternatively thereto, the lubricant separator and the lubricant sump can also be arranged outside the housing 10, wherein they are always located on the high pressure side.

The lubricant is taken up from the lubricant sump 58 via a lubricant filter 60 and is available for lubricating the bearings 42 and 44 on the low pressure side as well as the bearings 46 and 48 on the high pressure side and the screw rotors 36 and 38 in the rotor bores 32 and 34.

Figure 2:
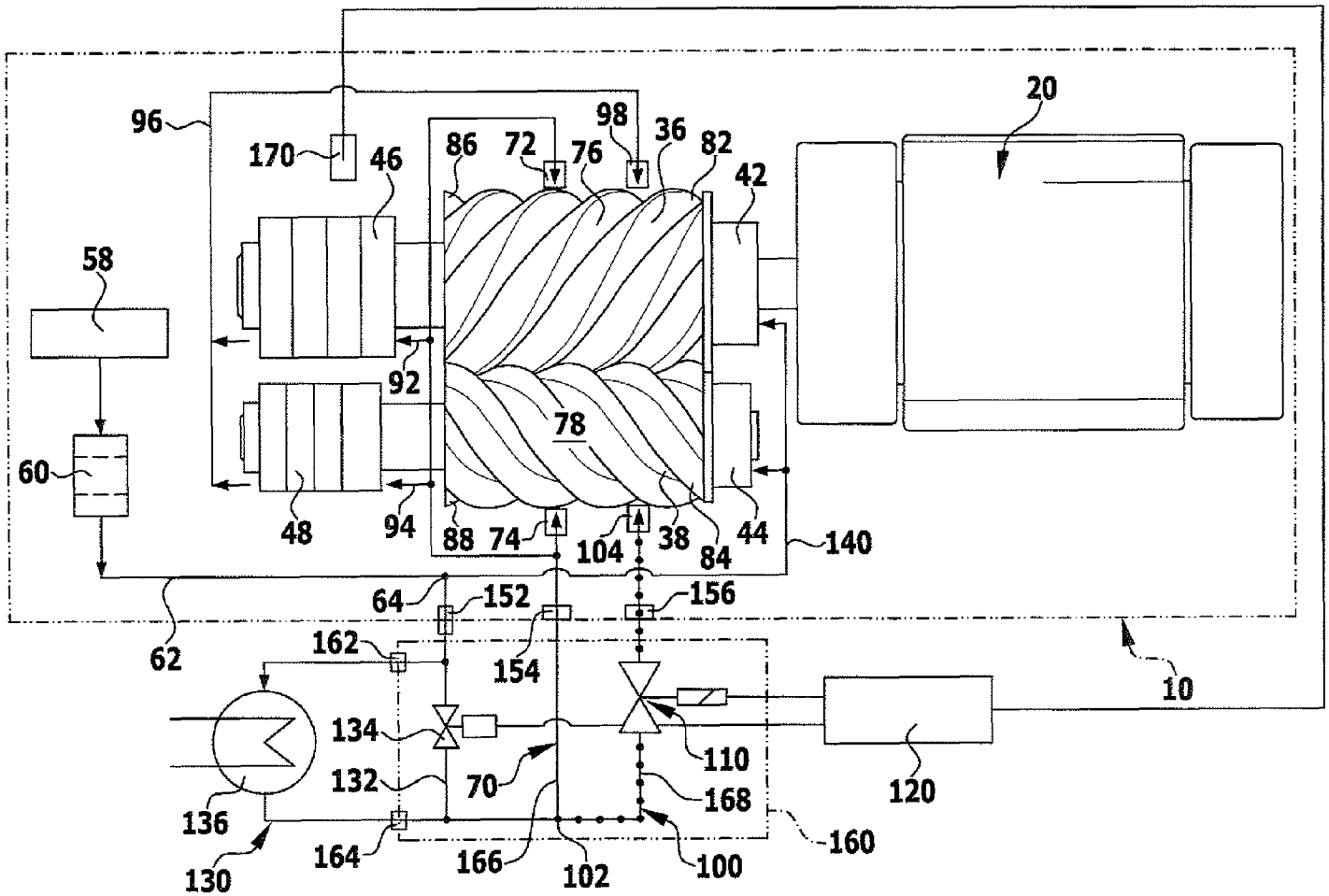
FIG. 2 shows a schematic illustration of a screw compressor according to the invention with a lubricant supply device according to the first embodiment and FIG. 3 shows an illustration similar to FIG. 2 of a lubricant supply device in a second embodiment of a screw compressor according to the invention.

As illustrated schematically in FIG. 2, the lubricant flows from the lubricant filter 60 in a lubricant conveyor line 62 to a branch 64, via which a first lubricant supply system 70, illustrated in solid lines in FIG. 2, guides the lubricant to supply openings 72 and 74 which are associated with the rotor bores 32 and 34 and supply lubricant to the screw rotors 36 and 38 in the areas 76 and 78 which are located between suction sides 82 and 84 as well as high pressure sides 86 and 88 thereof.

Furthermore, the first lubricant supply system 70 comprises lubricant outlets 92 and 94 for the lubrication of the bearings 46 and 48 on the high pressure side, wherein the lubricant flowing through the bearings 46 and 48 on the high pressure side will, for example, be collected again and supplied via a collecting line 96 to an additional supply opening 98 associated, for example, with the first screw rotor 32, wherein the supply opening 98 is located between the supply opening 72 and the suction side 82 of the screw rotor 32.

A second lubricant supply system 100, illustrated in FIG. 2 by dash-dot lines, is provided parallel to the first lubricant supply system 70, wherein both the first lubricant supply system 70 and the second lubricant supply system 100 proceed from a branch 102 which is connected to the branch 64 and, therefore, fed from the lubricant conveyor line 62. The second lubricant supply system 100 guides lubricant to a supply opening 104 which is associated, for example, with the screw rotor 34 but it is certainly possible to also provide a supply opening associated with the first screw rotor 32 in the second lubricant supply system 100.

Furthermore, a control valve designated as a whole as 110 is provided in the second lubricant supply system 100 and this can be controlled by a compressor control 120 and with it the second lubricant supply system 100 can be operated in a controlled manner by means of the compressor control 120.

An activatable and deactivatable lubricant cooling device 130 is located between the branch 64 and the branch 102, from which the first lubricant supply system 70 and the second lubricant supply system 100 proceed, and this lubricant cooling device comprises a lubricant cooler 136 which can be operated in the active state or in the inactive state or in intermediate states therebetween by way of a bypass line 132 with a control valve 134 provided in the bypass line 132.

Furthermore, a third lubricant supply system 140 leads from the branch 64 to the bearings 42 and 44 on the low pressure side in order to supply them with lubricant.

Alternatively thereto, the third lubricant supply system 140 can also branch off from the branch 102 so that at least lubricant which can be cooled can likewise flow through it.

The housing 10 is preferably designed such that it has a lubricant outlet 152 connected to the branch 54 as well as a lubricant inlet 154 for the first lubricant supply system 70 as well as a lubricant inlet 156 for the second lubricant supply system 100.

A distributor unit designated as a whole as 160 is connected to the lubricant outlet 152 and the lubricant inlets 154 and 156 and external connections 162 and 164 are provided in this distributor unit for connecting the external lubricant cooler 136 as well as the bypass line 132 to the control valve 134 and, in addition, the branch 102 is provided in this unit with a supply line 166 to the lubricant inlet 154 of the first lubricant supply system and with a supply line 168 to the lubricant inlet 156 of the second lubricant supply system 100, wherein the control valve 110 is also arranged in the supply line 168.

The distributor unit 160 is preferably mounted on the housing 10 as an external unit and borders on the lubricant outlet 152 as well as the lubricant inlets 154 and 156 in order to provide a connection to the bypass line 132 as well as the supply lines 166 and 168.

The screw compressor according to the embodiment illustrated works as follows:

During normal load operation, i.e. a load on the screw compressor in accordance with normal operating cycles, the second lubricant supply system 100 is inactive since the compressor control 120 closes the control valve 110.

In this case, lubricant will be supplied to the screw rotors 36, 38 and the bearings 42, 44, 46, 48 only via the first lubricant supply system 70 as well as the third lubricant supply system 140 and this lubricant will again be collected in the lubricant sump 58 and made available for renewed lubrication.

The amount of lubricant which is used during normal load operation depends on how large the difference in pressure is between the lubricant sump 58 which is subject to high pressure and essentially the supply openings 72 and 74 as well as 98 since lubricant will essentially be conveyed as a result of this difference in pressure.

During normal load operation, the compressor control 120 can also open the control valve 134 so that the lubricant cooler 136 does not have circulating lubricant flowing through it to any appreciable degree.

It is, however, also possible to close the control valve 134 or operate it in a phased or modulated manner in order to have either the entire circulating lubricant flowing through the lubricant cooler 136 or some of it flowing through the lubricant cooler 136 and, therefore, to discharge heat from the housing 10 as a result of the cooling of the lubricant.

If, however, the screw compressor according to the invention is working in high load operation, i.e. with a high loading, it is necessary to discharge as large an amount of heat as possible from the housing 10 for the purpose of stabilizing the temperature via the lubricant. For this reason, the control valve 134 is closed during high load operation and so the bypass line 132 is blocked and all the lubricant flowing to the branch 102 flows through the lubricant cooler 136.

Furthermore, the amount of circulating lubricant will be increased considerably by activating the second lubricant supply system 100 on account of the control valve 110 being opened by the compressor control 120, particularly since the supply opening 104 is located closer to the suction sides 82 and 84 of the screw rotors 32 and 34 than the supply openings 72 and 74 and so a greater difference in the pressure conveying the lubricant is available in the second lubricant supply system 100. The amount of lubricant flowing through the second lubricant supply system 100 during high load operation is preferably more than 0.5 times the amount of lubricant flowing through the first lubricant supply system 70; this amount of lubricant can preferably stretch approximately up to the volume of the amount of lubricant flowing through the first lubricant supply system 70 so that, as a result, an efficient cooling of the screw compressor according to the invention is possible by means of the large amounts of lubricant flowing through the lubricant cooler 136.

The compressor control 120 can detect high load operation in the most varied of ways. For example, it is conceivable to detect high load operation on account of the input electric power of the drive motor 20 and/or it is possible to provide a temperature sensor 170 on the high pressure side or a lubricant temperature sensor, for example arranged in the lubricant sump 58, by means of which it is possible to ascertain when a temperature threshold is exceeded, which represents an indication for high load operation.

Alternatively to the mode of operation of the screw compressor according to the invention as described above, it is also possible, during normal load operation, to differentiate between a non-cooled and a cooled normal load operation, wherein during non-cooled normal load operation, for example with a very small load on the screw compressor, the control valve 134 is open whereas during cooled normal load operation, for example with a greater load on the screw compressor, the control valve 134 is closed and, therefore, the lubricant flows through the lubricant cooler 136 during cooled normal load operation, wherein the cooling capacity obtained is considerably less than during the high load operation described above on account of the smaller amount of lubricant for normal load operation.

Figure 3:
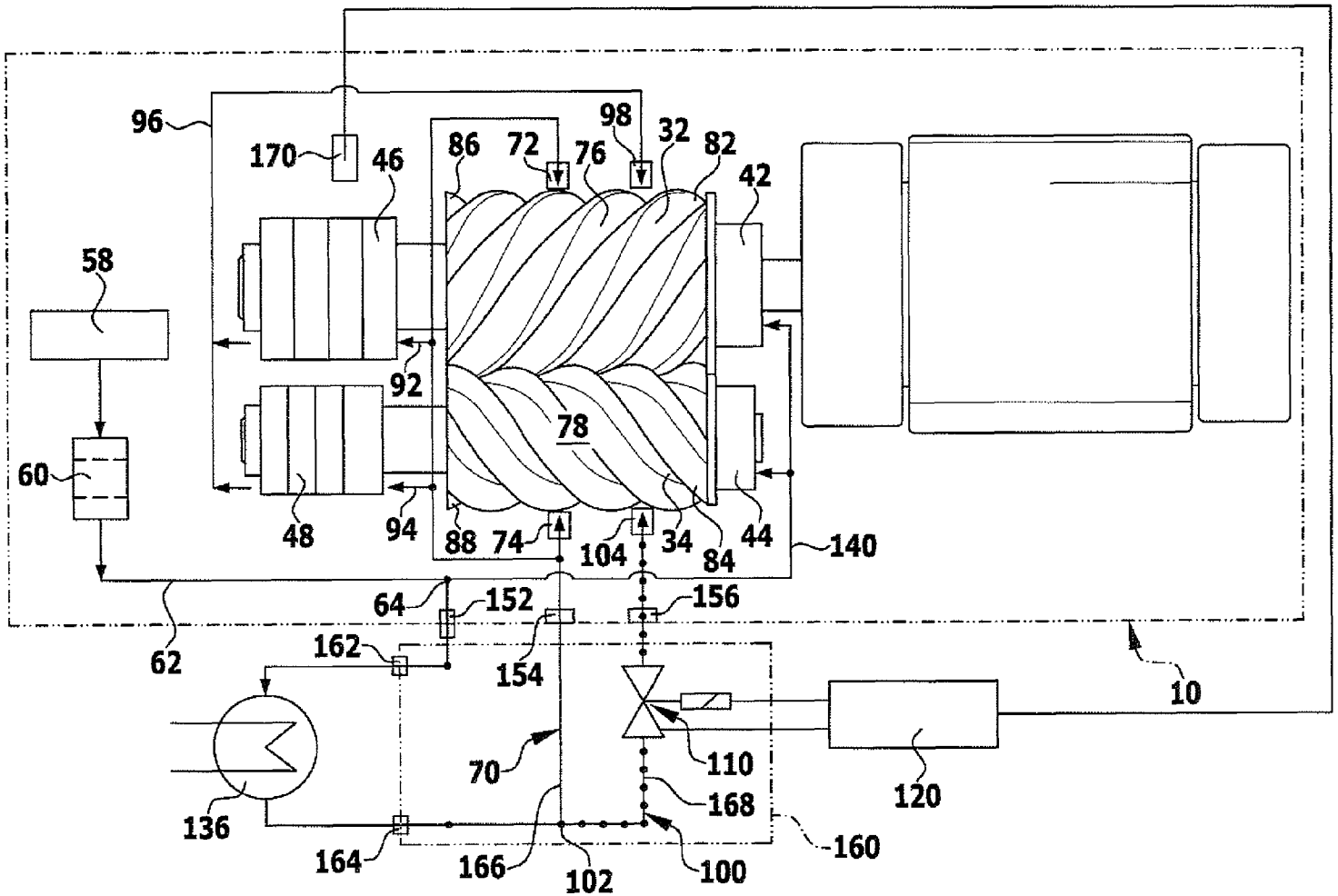

In a second, simplified embodiment of a compressor according to the invention, illustrated in FIG. 3, the bypass line 132 and the control valve 134 are left out and so the lubricant flowing to the branch 102 always flows through the lubricant cooler 136 and will be cooled in it.

The high load operation by way of connecting in the second lubricant supply system 100 leads to a significant increase in the amount of lubricant cooled by the lubricant cooler 136 and so, as a result, the cooling of the screw compressor during high load operation will be improved in accordance with the invention in comparison with normal load operation.

The invention claimed is:

1. Screw compressor comprising a housing, at least one screw rotor arranged in a compressor housing of the housing, a lubricant sump arranged on the high pressure side, lubricant collecting in said sump, and a lubricant supply device supplying lubricant from the lubricant sump to the at least one screw rotor, the lubricant supply device comprising a first lubricant supply system and a second lubricant supply system, a supply opening of the second lubricant supply system being located closer to the suction side of the at least one screw rotor than a supply opening of the first lubricant supply system, the first lubricant supply system supplies lubricant to the at least one screw rotor during operation of the screw compressor and the second lubricant supply system additionally supplies lubricant to the at least one screw rotor and is thereby activatable and deactivatable;

wherein the screw compressor is operable in a normal load operation and in a high load operation and the second lubricant supply system is deactivated during normal load operation and is activated during high load operation; and wherein a compressor control is provided, said control detecting whether normal load operation or high load operation is present.

2. Screw compressor as defined in claim 1, wherein normal load operation is present below a predeterminable threshold value for the load on the screw compressor and high load operation is present above the threshold value for the load.

3. Screw compressor as defined in claim 1, wherein normal load operation is carried out when a temperature measured on the high pressure side is below a predeterminable temperature threshold and high load operation when the measured temperature is above the temperature threshold.

4. Screw compressor as defined in claim 1, wherein the amount of lubricant flowing through the first lubricant supply system is determined by a difference in pressure between a pressure in the lubricant sump and a pressure at a supply opening to the at least one screw rotor.

5. Screw compressor as defined in claim 1, wherein the amount of lubricant flowing through the second lubricant supply system is determined by a difference in pressure between a pressure in the lubricant sump and a pressure at a supply opening to the at least one screw rotor.

6. Screw compressor as defined in claim 1, wherein the amount of lubricant conveyed by the first lubricant supply system is adapted to be cooled by a lubricant cooling device.

7. Screw compressor as defined in claim 6, wherein the lubricant cooling device constantly cools the amount of lubricant conveyed by the first lubricant supply system.

8. Screw compressor as defined in claim 6, wherein the lubricant cooling device cools the amount of lubricant conveyed by the first lubricant supply system during high load operation of the screw compressor.

9. Screw compressor as defined in claim 1, wherein the amount of lubricant conveyed by the second lubricant supply system is adapted to be cooled by a lubricant cooling device.

10. Screw compressor as defined in claim 9, wherein the amounts of lubricant of the first and second lubricant supply systems are adapted to be cooled with the lubricant cooling device.

11. Screw compressor as defined in claim 1, wherein a lubricant cooling device operable in an active state or an inactive state and/or in states therebetween is provided.

12. Screw compressor as defined in claim 11, wherein the lubricant cooling device has a lubricant cooler operable by way of a controllable bypass line in all possible states from the active state up to the inactive state.

13. Screw compressor as defined in claim 1, wherein a lubricant outlet for the supply of lubricant to the lubricant supply systems as well as lubricant inlets for the supply of lubricant to the first lubricant supply system and to the second lubricant supply system are provided on the housing.

14. Screw compressor as defined in claim 13, wherein the lubricant outlet and the lubricant inlets open into a distributor unit adapted to be mounted on the housing.

15. Screw compressor as defined in claim 14, wherein the distributor unit has connections for an external lubricant cooler.

16. Screw compressor as defined in claim 15, wherein lubricant fed back from the lubricant cooler is suppliable to the first lubricant supply system and the second lubricant supply system in the distributor unit.

17. Screw compressor as defined in claim 15, wherein a control valve is provided in the distributor unit prior to the lubricant inlet of the second lubricant supply system.

* * * * *